US011019858B1

(12) United States Patent
Freixas

(10) Patent No.: US 11,019,858 B1
(45) Date of Patent: Jun. 1, 2021

(54) SELF-ADJUSTING SYSTEM FOR JOINT PROTECTION

(71) Applicant: Oscar Freixas, Miami, FL (US)

(72) Inventor: Oscar Freixas, Miami, FL (US)

( * ) Notice: Subject to any disclaimer, the term of this patent is extended or adjusted under 35 U.S.C. 154(b) by 430 days.

(21) Appl. No.: 15/062,612

(22) Filed: Mar. 7, 2016

Related U.S. Application Data

(63) Continuation-in-part of application No. 13/751,566, filed on Jan. 28, 2013, now abandoned.

(51) Int. Cl.

| | |
|---|---|
| ***A41D 13/06*** | (2006.01) |
| ***A41D 13/015*** | (2006.01) |
| ***A41D 13/08*** | (2006.01) |
| ***A41D 13/05*** | (2006.01) |

(52) U.S. Cl.
CPC ..... *A41D 13/015* (2013.01); *A41D 13/0568* (2013.01); *A41D 13/06* (2013.01); *A41D 13/08* (2013.01)

(58) Field of Classification Search
CPC .. A41D 13/00; A41D 13/015; A41D 13/0153; A41D 13/0543; A41D 13/0568; A41D 13/06; A41D 13/08; A61F 2005/0176; A61F 5/0123; A61F 5/00; A61F 5/0106; A63B 21/0407; A63B 21/00185; A63B 21/068
USPC ..... 2/455, 456, 242, 16, 22, 23, 24; 128/881; 602/28, 26, 23; 482/124, 125
See application file for complete search history.

(56) References Cited

U.S. PATENT DOCUMENTS

| | | | | |
|---|---|---|---|---|
| 1,105,569 A | | 7/1914 | Lacrotte | |
| 1,136,307 A | * | 4/1915 | Bourdon | A41D 13/018 2/456 |
| 1,269,829 A | * | 6/1918 | Lumley | A41D 13/065 2/24 |
| 1,510,325 A | * | 9/1924 | Landon | A41F 11/02 2/24 |
| 1,583,181 A | | 5/1926 | Rubio | |
| 1,608,032 A | * | 11/1926 | McNabb | A61F 5/0104 602/30 |
| 2,195,024 A | | 3/1940 | Bullock | |
| 2,266,886 A | * | 12/1941 | McCoy | A41D 13/0506 2/22 |

(Continued)

OTHER PUBLICATIONS

"Strap" The Free Dictionary by Farlex. Web. https://www.thefreedictionary.com/strap.*

*Primary Examiner* — Jillian K Pierorazio
(74) *Attorney, Agent, or Firm* — Malloy & Malloy, P.L.

(57) ABSTRACT

A self-adjusting system for joint protection comprising a joint protector pad aligned relative to a joint and disposable between an operative orientation and a spaced orientation in relation thereto. A first attachment assembly of at least one elongate strap connects the joint protector to a foot or hand of the wearer, and a second attachment assembly of an elongate strap(s) connecting the joint protector to a point near the torso of the wearer, such as a waistband or belt. In a spaced orientation when the joint is straight, the joint protector is spaced apart from the joint so as not to impede movement. In an operative orientation when the joint is flexed, the joint protector at least partially covers the joint, supporting and protecting it from the underlying surface. The strap(s) ensure the joint protector is automatically properly aligned in moving between the spaced and operative orientation.

14 Claims, 3 Drawing Sheets

(56) References Cited

U.S. PATENT DOCUMENTS 2,557,604 A * 6/1951 Invidiato ..... A61F 5/0125 403/102
3,295,517 A 1/1967 Stevens
3,331,083 A * 7/1967 Holly ..... F41H 1/00 2/2.5
3,670,339 A 6/1972 Cooper et al.
3,712,299 A * 1/1973 Voehl ..... A41D 13/065 602/26
4,252,112 A * 2/1981 Joyce ..... A61F 5/0104 601/34
4,422,453 A * 12/1983 Salort ..... A61F 5/0102 602/23
4,561,123 A * 12/1985 Hull ..... A41D 13/065 2/16
4,580,297 A 4/1986 Maejima
4,599,748 A * 7/1986 Garcia ..... A61F 5/0123 2/22
4,633,529 A * 1/1987 Litz ..... A63B 71/1225 2/22
4,692,946 A * 9/1987 Jurga ..... A63B 71/1225 2/22
4,999,847 A * 3/1991 Barcelo ..... A63B 71/1225 2/22
5,005,565 A * 4/1991 Fratesi ..... A41D 13/0568 2/22
5,091,992 A 3/1992 Pusic
5,107,823 A * 4/1992 Fratesi ..... A41D 13/0568 2/22
5,134,726 A 8/1992 Ross
5,220,691 A * 6/1993 Wiegers ..... A41D 13/065 2/2.5
5,222,256 A * 6/1993 Wang ..... A41D 13/0568 2/16
D346,245 S * 4/1994 Krent ..... D29/121.1
5,385,534 A 1/1995 Cassford
5,387,185 A 2/1995 Johnson, Jr. et al.
5,431,623 A * 7/1995 Rice ..... A61F 5/0106 2/22
5,452,475 A * 9/1995 Hunt, Jr. ..... A63B 71/1225 2/22
5,500,955 A 3/1996 Gongea
5,537,689 A 7/1996 Dancyger
D373,892 S 9/1996 Landwehr
5,561,857 A * 10/1996 Hoshizaki ..... A63B 71/1225 2/22
5,581,805 A * 12/1996 Rennick ..... A41D 13/0156 2/22
5,611,081 A * 3/1997 Torres ..... A41D 13/0593 2/227
5,652,957 A * 8/1997 Williford ..... A41D 13/05 2/214
5,662,594 A * 9/1997 Rosenblatt ..... A61F 5/0125 2/16
5,716,307 A 2/1998 Vadher
5,915,529 A * 6/1999 Popowski ..... A41D 13/0568 2/16
5,933,874 A * 8/1999 Randolph ..... A41D 13/0518 2/267
5,961,476 A 10/1999 Betto et al.
6,029,273 A 2/2000 McCrane
6,099,446 A 8/2000 Johnson et al.
6,119,274 A 9/2000 Graham
6,178,556 B1 * 1/2001 Foreman ..... A63B 71/08 128/882
6,179,760 B1 * 1/2001 Rumbaugh ..... A41D 31/18 482/121
6,190,342 B1 * 2/2001 Taylor ..... A61F 5/026 602/19
6,338,164 B1 1/2002 Howard
6,361,517 B1 * 3/2002 Slinger ..... A61F 5/0113 36/140
6,428,495 B1 * 8/2002 Lynott ..... A61F 5/3715 128/875
6,551,264 B1 * 4/2003 Cawley ..... A61F 5/0125 128/882
6,654,962 B2 12/2003 Demott
6,802,080 B2 * 10/2004 Hawley ..... A41D 13/065 2/22
6,837,834 B2 * 1/2005 Basting ..... A63B 21/0552 482/121
6,839,917 B1 1/2005 Landwehr
6,912,729 B2 * 7/2005 Nishimoto ..... A63B 71/1225 2/22
6,964,062 B1 * 11/2005 Chen ..... A41D 13/065 2/22
7,096,507 B1 * 8/2006 Bolden ..... A41D 13/05 2/22
7,458,949 B2 12/2008 Castillo et al.
7,517,331 B2 4/2009 Reinhardt et al.
7,549,969 B2 6/2009 Van Den Bogert
7,578,800 B2 * 8/2009 Castillo ..... A61F 5/0123 128/882
7,707,649 B2 * 5/2010 Dancyger ..... A41D 13/065 2/24
8,141,170 B2 * 3/2012 Paterno ..... A41D 13/065 2/24
8,894,596 B2 11/2014 Vedder et al.
9,144,253 B1 * 9/2015 Munter ..... A41D 13/065
10,179,061 B2 * 1/2019 Wiemann ..... A61F 5/0113
2002/0068667 A1 * 6/2002 Strachan ..... A63B 21/4015 482/124
2002/0161320 A1 10/2002 Hogg
2002/0188997 A1 12/2002 Lyden
2003/0130098 A1 * 7/2003 Marco ..... A63B 21/4015 482/124
2003/0167548 A1 9/2003 Lashoto et al.
2005/0277859 A1 * 12/2005 Carlsmith ..... A61F 5/0125 602/20
2006/0107433 A1 * 5/2006 Olson ..... A61F 5/0104 2/22
2006/0137071 A1 * 6/2006 Rampersad ..... A41D 13/0556 2/24
2006/0167396 A1 7/2006 Berger
2007/0135278 A1 6/2007 Grigoriev et al.
2007/0163025 A1 * 7/2007 Godshaw ..... A41D 13/0568 2/24
2008/0039303 A1 * 2/2008 Wilcocks ..... A63B 21/4011 482/124
2008/0051686 A1 2/2008 Ashihara
2008/0072359 A1 3/2008 Goldshaw et al.
2008/0115248 A1 * 5/2008 Meadows ..... A41D 13/0556 2/22
2008/0125685 A1 * 5/2008 Bernardoni ..... A61F 5/0102 602/32
2008/0167144 A1 * 7/2008 Brunst ..... A63B 69/0002 473/452
2008/0178360 A1 * 7/2008 Nascimento ..... A63B 71/1225 2/22
2009/0083901 A1 * 4/2009 Pardillo ..... A41D 13/0556 2/455
2010/0076360 A1 3/2010 Shimada et al.
2010/0095422 A1 * 4/2010 Lopez ..... A41D 13/065 2/23
2010/0107291 A1 5/2010 Carter
2010/0192269 A1 8/2010 Saranga
2010/0235960 A1 * 9/2010 Johnson ..... A41D 13/065 2/23
2011/0067159 A1 3/2011 Smith
2011/0094001 A1 * 4/2011 Maldonado ..... A41D 13/065 2/24
2011/0207585 A1 8/2011 Burns
2011/0219510 A1 9/2011 Nuzzo
2011/0312160 A1 12/2011 Eldada et al.
2012/0011632 A1 * 1/2012 Guiney ..... A63B 27/00 2/16
2012/0117706 A1 5/2012 Tateo
2012/0131729 A1 5/2012 Hernandez
2012/0202658 A1 8/2012 Menafee, Sr.

(56) References Cited

U.S. PATENT DOCUMENTS

| | | | | |
|---|---|---|---|---|
| 2012/0233736 | A1* | 9/2012 | Tepper | A41D 13/0153 2/24 |
| 2013/0025017 | A1* | 1/2013 | Chen | A63B 71/1225 2/22 |
| 2013/0298317 | A1 | 11/2013 | Fonte | |
| 2013/0333097 | A1 | 12/2013 | Cranke et al. | |
| 2014/0020160 | A1 | 1/2014 | Ford et al. | |
| 2014/0096299 | A1 | 4/2014 | Meraz | |
| 2014/0171276 | A1* | 6/2014 | Strachan | A63B 21/00185 482/124 |
| 2014/0173813 | A1 | 6/2014 | Mazzarolo | |
| 2014/0182041 | A1 | 7/2014 | Archuleta | |
| 2014/0208490 | A1* | 7/2014 | Freixas | A41D 13/0568 2/455 |
| 2014/0215679 | A1 | 8/2014 | Habip | |
| 2014/0237696 | A1 | 8/2014 | Carver et al. | |
| 2014/0276303 | A1 | 9/2014 | Matthews et al. | |
| 2014/0283275 | A1 | 9/2014 | Pratson et al. | |
| 2014/0304900 | A1 | 10/2014 | Sugano et al. | |

* cited by examiner

SELF-ADJUSTING SYSTEM FOR JOINT PROTECTION

The present application is a Continuation-In-Part application of previously filed, now pending application having Ser. No. 13/751,566 which was filed on Jan. 28, 2013 incorporated herein by reference.

BACKGROUND OF THE INVENTION

Field of the Invention

The present invention relates generally to pads, and more specifically, to pads for covering joint(s) such as knee pads or elbow pads, to protect and cushion the same.

Description of the Related Art

Pads have been used for decades to cushion the joint of a wearer, such as a knee or elbow on which pressure may be placed during certain activities. For instance, knee pads are commonly used in construction and gardening, and other activities involving kneeling for a prolonged period of time, to reduce pain and alleviate pressure applied to the joint that could otherwise damage the joint. Knee and elbow pads also are employed during sporting activities, such as cycling and skating, to protect the joints from cuts, abrasions, and impact damage that often accompanies sports in which the joints may be scraped, bumped, or take the brunt of a fall. They often protect not just the skin, but the bone, cartilage, and ligaments of the joint as well.

For all their virtues, joint pads still suffer from some major drawbacks. Most joint pads have straps that wrap around the limb of a wearer, such as a leg in the case of a knee pad, to secure the pad in position relative to the protected joint. There are often straps on both sides of the joint, so that the pad does not drift from position during movement. To ensure the pad remains in position, however, these straps are often pulled tightly around the leg or arm of the wearer. This is not only uncomfortable for the wearer, pinching and squeezing the thigh, calf, or arm, but in extreme cases may impede circulation through the limb and affect dexterity. Moreover, straps wrapped around the leg or arm of the wearer will often rub against the skin, irritating and chafing the skin of the wearer the longer the pad is employed. Such irritation occurs whether the pad and straps are applied directly to the skin or over clothing. This irritation is often worse along compressed areas, such as the back of the knee or inner arm, since these areas are subject to increased pressure, higher temperatures, and perspiration during use, such as when the joint is flexed, which only aggravates the irritation. In extreme cases, the irritation and chafing may lead to blistering and even bleeding.

These disadvantages are compounded over time, such that while brief use may be tolerable, longer use such as for hours or even days, can have a debilitating effect and may not be tolerable at all. Indeed, the discomfort from irritation and chafing over prolonged use of a joint pad may eclipse the pain or pressure to the joint without the use of the pad, and some users will forgo use of a joint pad after a time as a result of these debilitating side effects.

Other known joint protection pads clip to clothing to secure the pad in place. These too, however, often wrap around and/or squeeze the attendant limb, thereby suffering the same drawbacks as discussed above. Moreover, the clips are subject to easily disengage when the pad is hit or impacted, and so are not effective in keeping the pad in position to properly cover and protect the joint.

Regardless of how joint protector pads are secured to a wearer, they all shift out of position over time during use, and must be repositioned. This often involves manually moving, shifting, or repositioning the pad and/or straps to return them to their original position. Such repositioning therefore requires the wearer to stop what they are doing to see to the pad and straps, interrupting their activity. Moreover, a shifted pad and/or strap distracts the wearer from their activity until repositioned, which can be significant amount of time until it is convenient to take a break. In some instances, such as in war or on patrol, waiting for a convenient time is not an option, because of the distraction.

It is therefore evident that a better form of joint protector pad is needed to properly protect the joint of a wearer without causing damage or irritation to the wearer. A pad that can be worn for long periods of time would also be beneficial, as would a pad that does not need to be repositioned periodically.

SUMMARY OF THE INVENTION

The present invention is directed to a system for protecting a joint of a wearer, such as a hinge joint of a knee or elbow. The system provides a joint protector pad to protect, cushion, and/or support a joint in an operative orientation, when the joint is flexed or bent. In a spaced orientation, when the joint is straight, the joint protecting pad is spaced apart or disposed outwardly from the joint and is in a "free floating" position or relation to the joint. Rather than having straps that wrap around the leg or arm, the present system includes a set of straps that extend outwardly from opposite ends or sides of the joint protector pad in opposite directions. As such, the set of straps attach to the wearer at the foot, or other corresponding body part, in one direction, and the torso in the opposite direction.

The joint protector pad is therefore always properly aligned so that when the joint is flexed, the protector pad goes directly into contact with the joint automatically. When the joint is straightened, the straps automatically pull the joint protector pad back into spaced aligned relation to the joint, without any need to manually manipulate the pad or straps. Accordingly, the joint protector pad is always ready and in proper alignment for protecting the joint, and yet is not inhibiting to the joint. The present system eliminates the need for strangulating straps to keep the joint in place, freeing the joint for increased movement without sacrificing protection, and saving the surrounding skin and tissue from irritation and damage. It is also self-adjusting, abolishing the need to manually reposition the pad or straps.

Specifically, the system includes a joint protector aligned with a joint to protect the same. The joint protector may be any type of protection or pad, and may include impact resistant material or frictional material on the outer surface, and cushioning material on the inner surface. A first attachment assembly including one or more straps extends from the joint protector to the extremity, such as a foot or hand, and attaches thereto, such as by loop and/or clips or other attachment member(s). A second attachment assembly includes one or more straps extending from an opposite side of the joint protector, securing at the torso of the wearer, such as at the waistband or belt loops. In at least one embodiment, the straps of the attachment assemblies are slightly elastic, such that they are taut even in the spaced orientation, but remain capable of stretching, such as in the operative orientation. Each strap is also adjustable to accommodate any size or height of the wearer.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention is directed to a system and or assembly for protecting a joint of a wearer, such as a hinge joint of a knee or elbow. The system and/or assembly may be employed by a person during any activity in which joint protection is desired, or when potential damage to the joint from impact or pressure may occur. Examples include, but are not limited to: construction such as welding, roofing, and floor work; gardening; sports, such as skateboarding, cycling, and skiing; and military activities including patrols, transport, missions, operations, enemy engagement, and even battle.

The assembly includes a joint protector pad which may be aligned with a correspondingly positioned joint to be protected. When applied, the joint protector is connected to a wearer in an uninhibited manner, such that the wearer has the same freedom of motion he or she would have were they not wearing the joint protector system. The limbs of the wearer are not squeezed, pinched, or constrained in any way. When the need arises to kneel or land on a knee or elbow, for example, the corresponding, protective joint is flexed or bent. As the joint flexes the assembly concurrently moves into an operative orientation to "automatically" position the joint protector into a covering and protecting relation to the joint. Accordingly, such "automatic" positioning is accomplished without handling, gripping or other direct manual manipulation of the joint protector by the wearer. As soon as the corresponding joint is straightened or extended out of the flexed or bent position, the joint protector pulls outwardly, away from the joint and into a spaced orientation. Therefore, "automatic" disposition of the joint protector into either the operative orientation or the spaced orientation, as defined herein, is accomplished by limb movement rather than manual manipulation of the joint protector by the wearer. Therefore, the assembly of the system of the present invention is automatically, self-adjusting.

Specifically, and as shown throughout the Figures, the present invention is a system 100 for protecting the joint of a wearer. Different joints may be protected by the system and assembly of the present invention. However, in at least one embodiment the system and corresponding assembly is particularly useful in protecting joints such as, but not limited to, the knee or elbow. It is also noted that certain joints of the human body specifically including the knee or elbow, flex by bending in one direction.

Figure 3:
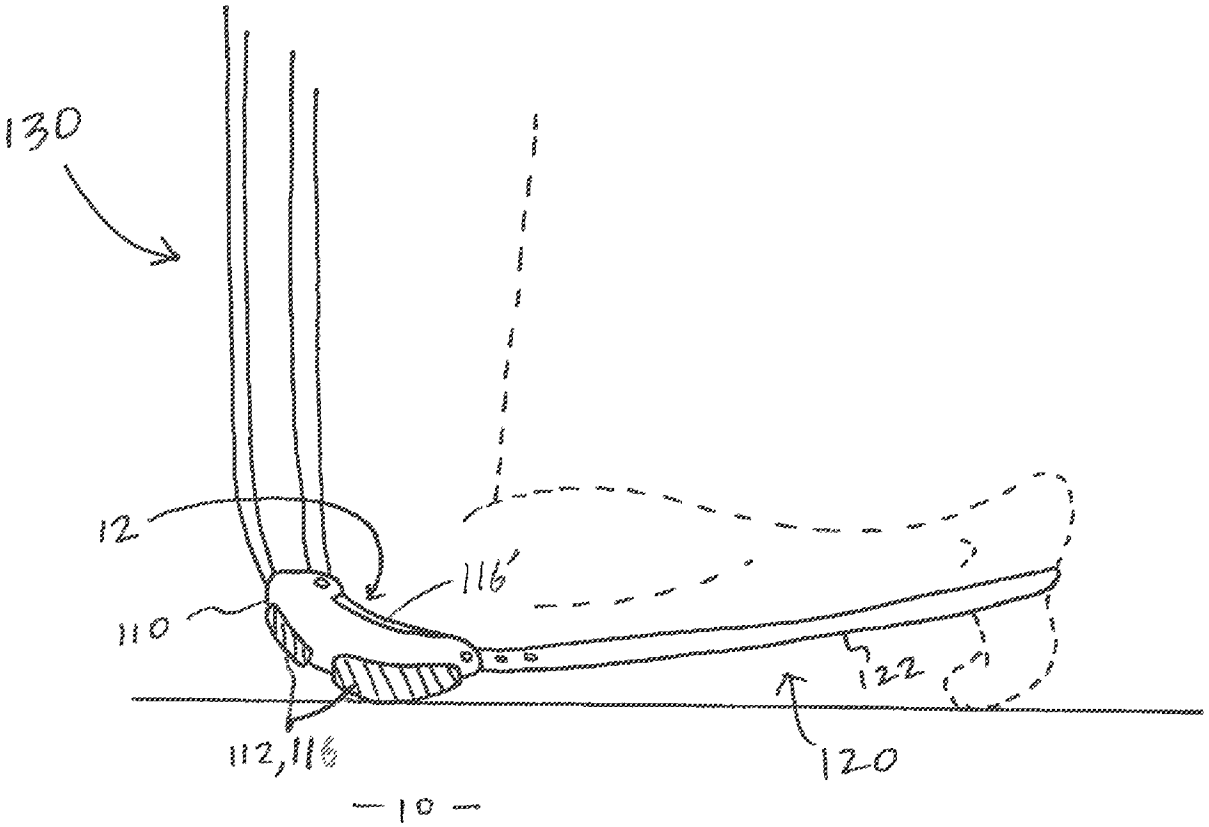
FIG. 3 is a side view in schematic form of the embodiment of FIGS. 1 and 2 as disposed on a leg of a wearer in an operative orientation and in protecting relation to the knee joint.
Figure 4:
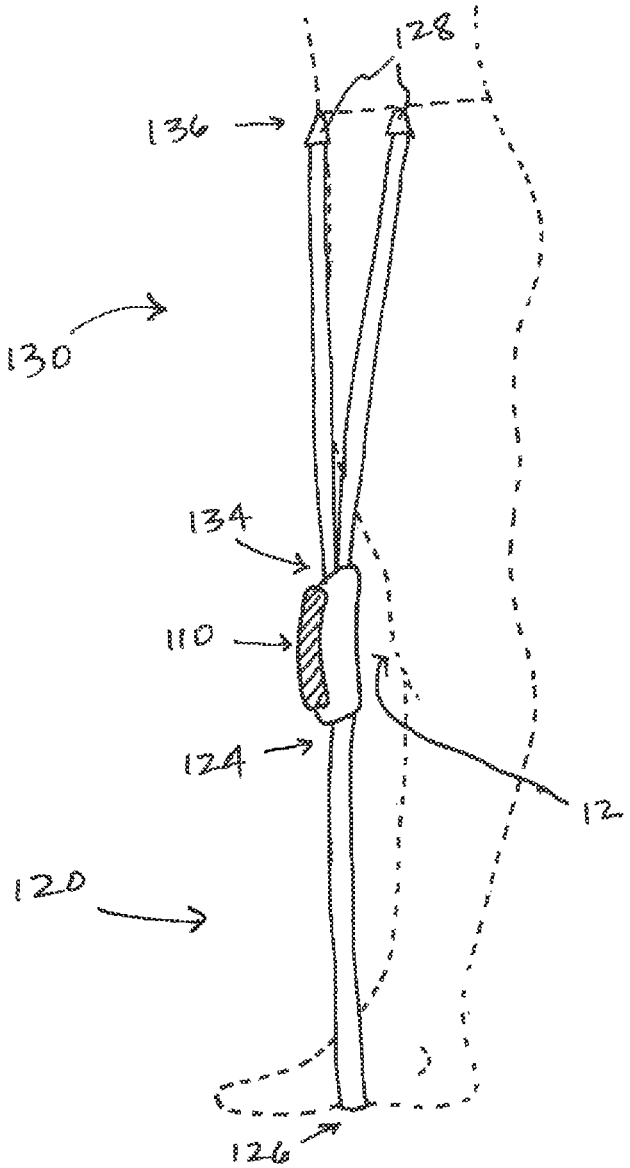
FIG. 4 is a side view in schematic form of the embodiment of FIGS. 1-3 disposed in association with a leg of a wearer in a spaced orientation.

To provide context to the invention, and for illustrative purposes only, FIGS. 3 and 4 show the system 100 and an assembly 110 used with a knee joint. Moreover, it should also be clearly understood that neither the wearer, nor any body part such as joints, are the subject of this invention or are part of the claimed invention, but rather are discussed and illustrated herein merely to provide a contextual environment in which the system 100 and the assembly 110 of the present invention is utilized.

As shown throughout the Figures, the system 100 includes the assembly comprising least one joint protector, both designated herein as 110. Further, the joint protector 110 is structured to be connected to the wearer and operatively disposed in corresponding relation to the joint to provide protection to the joint, under certain conditions. For instance, the joint protector 110 may be any size or shape appropriate to receive, fit, cover, protectively engage and/or at least partially conform to the shape of the corresponding joint with which it is operatively positioned and associated. As demonstrated throughout the Figures the joint, represented to fully describe the structural and operative features of the system 100 is the knee joint. However, various other joints, such as the elbow joint, may be similarly protected by appropriate mounting and positioning of the system 100 and joint protector 110.

Figure 1:
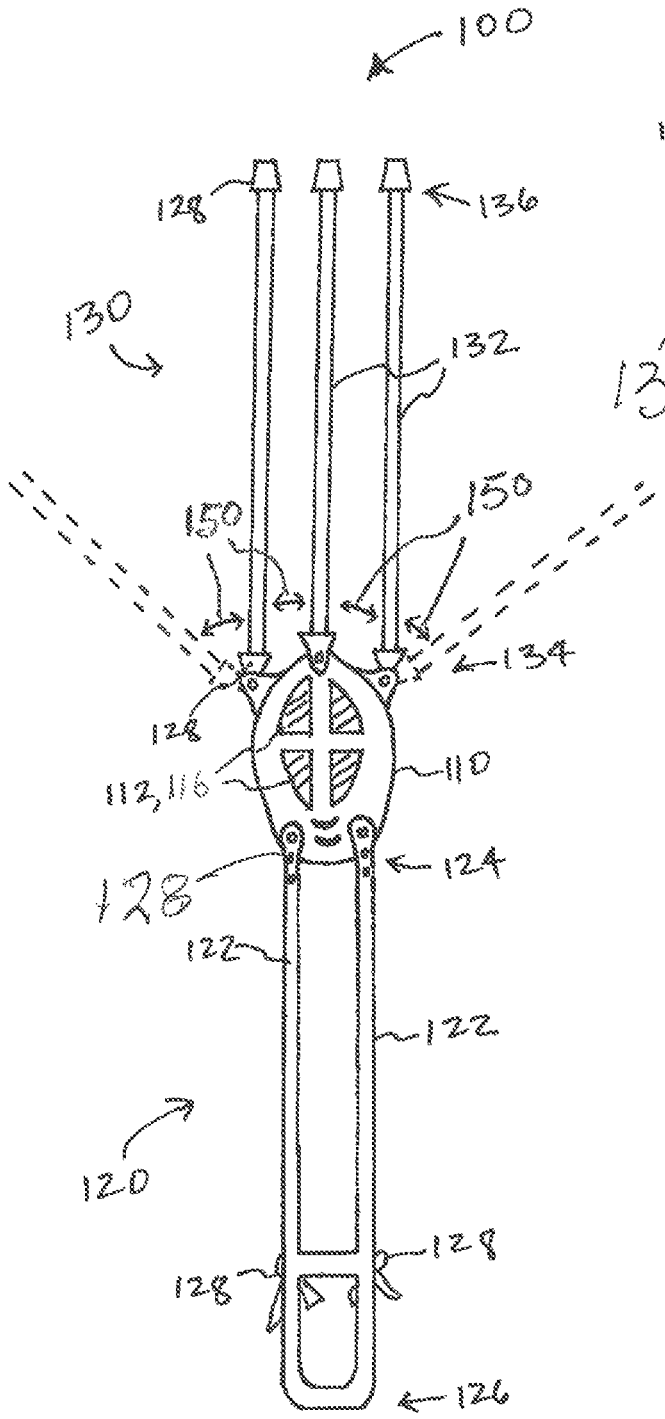
FIG. 1 is a schematic representation of one embodiment of the present system, showing an outer and/or front elevation thereof.
Figure 2:
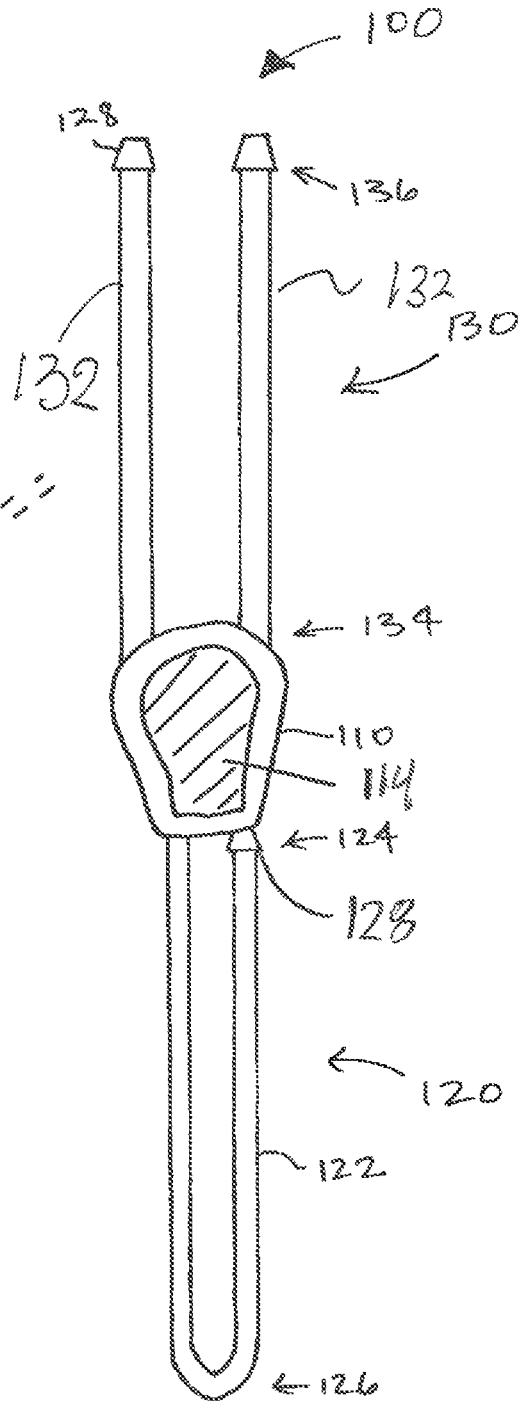
FIG. 2 is a schematic representation of a rear view of the embodiment of FIG. 1.

The structural and operative versatility of the system 100 is demonstrated in the one or more embodiments represented in FIGS. 1 and 2. Accordingly, certain distinguishing features of the joint protector 110 in the embodiments of FIGS. 1 and 2 may include different but appropriate materials such as, but not limited to, hard plastic, polymer, rubber, or silicone based materials, gels, textiles, etc., or any combination thereof. For example, the joint protector 110 may include a base made of a rigid material and a plurality of additional portions made of different materials.

Accordingly, as demonstrated in one or more embodiments of the system 100, the joint protector 110 may include an impact resistant portion(s) 112 disposed on an outer surface thereof, as shown in FIGS. 1 and 2. Such an impact resistant portion(s) 112 serves to reduce the force exerted on the corresponding the joint, such as when the joint protector 110 supports a knee joint on a supporting surface 10, as illustrated in FIG. 3. The impact resistant portion(s) 112 protect the joint from damage, such as from impact, pressure, force, etc., from the supporting surface 10 and objects thereon. By way of example only, if a soldier or other wearer needs to quickly fall to a knee, the impact resistant portion 112 of the joint protector 110 protects his/her knee from rocks, glass, debris and other objects on the ground, as well as the force resulting from rapidly assuming the represented kneeling position, that could harm the knee joint or distract the wearer. Moreover, there may be one impact resistant portion 112 to each joint protector or there may be multiple impact resistant portions 112 disposed across an outer surface of the joint protector, as shown in FIG. 1, in any one of a variety of different patterns or arrays thereon. The impact resistant portion(s) 112 may be made from any suitable material, such as hard plastic or polymers, but in at least one embodiment it is contemplated to be of a harder or sturdier material than at least some portions of a remainder of the joint protector 110.

As indicated above, the joint protector 110 preferably includes at least one pad or cushioning portion 114 disposed on an inner surface of the joint protector 110. The one or more cushioning portions 114 are structured to engage and support the joint in a flexed position and to provide relief from pressure or force applied to the joint. In addition to protecting against pressure or force, the cushioning portion 114 can be particularly useful to provide a measure of comfort to the wearer when employing the system 100 over an extended or prolonged period of time, such as when kneeling for hours while gardening, working or otherwise being disposed in an at least partially kneeling position. Accordingly, the cushioning portion 114 is made of any material suitable for absorbing pressure, such as compressive, pliable, resilient, and/or at least partially conforming material and may be soft to the touch as well. Non-limiting examples include gels, foams, batting, microbeads, cloth, etc. or combinations thereof.

In some embodiments, the joint protector 110 also includes at least one frictional portion 116 disposed on a surface of the joint protector 110 and structured to increase friction between the joint protector 110 and a supporting surface 10. By way of example only and as shown in FIG. 1, the frictional portion(s) 116 may be disposed on an outer surface of the impact resistant portion(s) 112 of the joint protector 110. In the alternative, the one or more frictional portions 116 may be structured independently of the one or more impact resistant portions 112, such as by being formed on other portions of the exterior of the joint protector 110, while still being disposable in engaging relation with the supporting surface 10. The frictional portion(s) 116 are structured to increase friction, and therefore reduce slippage, of the joint protector 110 along a supporting surface 10, as represented in FIG. 3, when disposed on the exterior of the joint protector 110, as set forth above 3. Accordingly, the frictional portion(s) 116 may assist the wearer in maintaining position once the joint has made contact with a support surface 10. Additional frictional portions 116' may also be disposed on an inner surface frictional of the joint protector 110, as also represented in FIG. 3. When so disposed, the frictional portions 116' may be made of a material which facilitates an increase in friction and/or reduces slippage between the joint being protected and the joint protector 110. However such material should also be sufficiently soft or otherwise structured to eliminate or significantly reduce any agitation or damage to the skin or exterior of the joint, when the joint protector is in the operative orientation represented in FIG. 3.

The joint protector 110 is disposable in aligned relation to the knee joint 12. Accordingly, when the knee joint 12 (or other joint with which the joint protector 110 may be used) is substantially straightened or fully extended, the joint protector 110 is disposed in the spaced orientation depicted in FIG. 4. Accordingly, when in the spaced orientation the joint protector 110 is aligned with the knee joint 12, but concurrently disposed in outwardly spaced relation to the knee joint 12. Therefore, when in the spaced orientation, the joint protector 110 is accurately described and defined as being in a free-floating position, meaning that the joint protector 110 is aligned with not in contact with the joint 12 and movable relative thereto to at least a minimal degree. Further, when in the spaced orientation of FIG. 4, the joint protector 110 is disposed to automatically assume the operative orientation upon a bending or flexing of the limb and joint 12. More specifically, when the joint 12 bends or flexes, the joint protector 110 will automatically be disposed from the outwardly spaced, free floating position of the spaced orientation into the operative orientation and in at least partially covering, engaging, contacting relation to the knee joint 12 as illustrated in FIG. 3. As represented in and as should also be apparent from FIG. 3, the joint protector 110 is in contact with the joint 12 and is at least partially supporting and protecting the joint, when the joint protector 110 is disposed in an operative orientation.

The system 100 of the present invention also includes a first attachment assembly 120 connected to one side or end of the joint protector 110, and a second attachment assembly 130 connected to a different, preferably opposite side or end of the joint protector 110, as shown throughout the Figures. More in particular, the first attachment assembly 120 comprises at least one strap, but possibly a plurality of straps 122 connected to the joint protector 110 at the proximal end 124 of the one or more straps 122. As depicted in the embodiment of FIG. 1, the one or more straps 122 connect to the joint protector 110 by at least one attachment member 128, which may be snaps, hooks, loops, ties, buttons, clips, alligator clips, or other suitable structure for removably but securely fastening one item to another. Moreover, the attachment member(s) 128 may allow for adjustment of the length and/or positioning of the strap(s) 122, such as by a plurality of holes, hooks, buckles or snaps that could be used to effectively lengthen or shorten the strap(s) 122. In other embodiments, such as depicted in FIG. 2, the strap(s) 122 may connect to the joint protector 110 by an attachment member 128 as described above, and/or by having at least one proximal end 124 fixedly fasten to the joint protector 110. Such fixed fastening can be accomplished by the corresponding one proximal end 124 being, glued, molded, melded, woven, or other methods of non-removable or permanent attachment thereto. Moreover, when a plurality of straps 22 are utilized, each strap 122 may attach in a different way, and in the case of a single strap 122 attaching twice (as in FIG. 2), can even be attached different ways at each attachment point.

As also noted herein, the first attachment assembly 120 includes at least one strap 122. In some embodiments, as in FIG. 1, the first attachment assembly 120 includes a plurality of straps 122. In other embodiments, as in FIG. 2, a single strap 122 is used. Regardless of the number of straps 122, they each extend from the proximal end 124 at the joint protector 110 to a distal end 126 which is securable to a limb extremity and or to a correspondingly positioned garment of the wearer.

The first attachment assembly 120 secures at the distal end 126 directly to the body of the wearer, such as feet or hands, or may secure to items of apparel such as clothing, boots, gloves, sleeves, pants, or other item being worn by the wearer at a position that is disposed at, near, or in the close vicinity of the limb extremity of the wearer. For example, in at least one embodiment the distal end 126 of the first attachment assembly 120 is structured and disposable in at least partially surrounding or encircling relation to a limb extremity, such as a foot or hand, or portion thereof. By way of example, FIGS. 3 and 4 show the distal end 126 of the first attachment assembly 120 configured as a harness that wraps around the arch or other appropriate portion of the foot. Although not clearly represented, a shoe or light garment may be typically worn on the foot of the wearer. Accordingly, when worn, the distal end 126 may be disposed exteriorly or interiorly relative to the shoe or like garment. Therefore, when the distal end 126 is on the inside of the shoe or like garment, the strap 122 is securely maintained in place and not likely to slip out. Similarly, in the case of elbow protectors, the distal end 126 of the strap 122 may be secured around the palm and/or heel of the hand, or a finger(s), and can be placed inside or outside a glove, if worn.

In some embodiments, such as shown in FIG. 1, the distal end 126 of the first attachment assembly 120 may also include at least one attachment member 128 as previously described, such as a clip, alligator clip, snap, button, tie, etc. for securely, yet removably, attaching the distal end 126 at or near the foot or limb extremity the wearer. For instance, the attachment member 128 may snap, clip, or otherwise securely fasten to a boot, pant leg, sock, hem, glove, sleeve, or other apparel worn at or near the foot or hand. This adds another level of security to ensure the first attachment assembly 120 stays in place was positioned and secured at the distal end 126.

Similarly, the second attachment assembly 130 comprises at least one strap 132 and connects to the joint protector 110 at a proximal end 134. The second attachment assembly 130 includes at least one but in some embodiments a plurality of straps 132. For instance, in the embodiment of FIG. 2, the second attachment assembly 130 includes a plurality of two straps 132. However, as represented in FIG. 1, the second attachment assembly 130 includes a plurality of three straps 132, for use in applications where additional sturdiness is needed, such as sports or military applications. As previously discussed, the strap(s) 132 may have their respective proximal ends 134 connected to the joint protector 110 at different, spaced locations from one another. The one or more straps 132 may employ the use of an attachment member 128 as previously described and shown in FIG. 1, or may be permanently attached thereto as previously described and/or combinations thereof. Each strap 132 may also include an adjustable length be adjustable along its length such as by, but not limited to adjusting the attachment member 128. Moreover, in embodiments such as FIG. 1 in which attachment member(s) 128 secure the strap(s) 132 to the joint protector 110, such attachment may allow for movement, such as rotational, pivotal, etc. movement about the attachment member 128. Accordingly, each of the strap(s) 132 may be independently at least partially moveable, as indicated by the arrows 150, so as to permit or accommodate various positioning, placement, and to some degree movement of the wearer when secured.

The second attachment assembly 130 and strap(s) 132 thereof, extend from an attachment at their proximal end 134 at the joint protector 110 to a distal end 136 which is securable, typically to a garment, at or near the torso, waist, etc. of the wearer. As used herein, torso refers to the trunk and/or waist of a wearer, such as depicted in FIG. 4. However, the second attachment assembly 130 may connect to the wearer at other appropriate locations in order to facilitate the "automatic" positioning of the joint protector 110 between the spaced orientation and the operative orientation.

The second attachment assembly 130 may also include at least one attachment member 128, as previously described, disposed at a distal end 136 of each of the one or more straps 132 and are operative to secure the strap(s) 132 directly to the body of the wearer. As also emphasized herein when the first or second attachment assembly 120 and 130 are described as being attached or connected to the wearer, each may in fact be connected to a garment of the wearer at a position that is appropriately disposed. By way of example, FIG. 4 shows the attachment members 128 securing the straps 132 to the waistband, belts, belt loops, etc. of the wearer.

As is evident from the Figures, the straps 122, 132 are elongate so as to extend from the joint protector 110 to the distal end 126, 136 located at a foot or torso of the wearer, respectively. Moreover, as distinguished from known or conventional protection devices, the straps 122, 132 do not wrap around the corresponding limb or other body portion of the wearer. As a result the straps 122, 132 are not tightened down or otherwise tightly secured in a wrapped or surrounding relation to the corresponding body part of the wearer. Accordingly, because the straps 122, 132 follow along a frontal portion of the wearer, as shown in FIGS. 3 and 4, rather than wrapping around the limb or other body part, both the one or more straps 122 and possibly at least a part of the one or more straps 132 have at least a majority of their lengths disposed in outwardly spaced relation and non-contacting or non-engaging relation to the frontal portion or any corresponding body part of the wearer, when in the spaced orientation. Concurrently, the joint protector 110 is also disposed, along with the majority of the lengths of the at least the one or more straps 122 of the first attachment assembly 120, in an outwardly spaced, non-contacting or non-engaging relation with a correspondingly disposed body part, adjacent the knee joint 12.

In contrast, when the system 100 is in the operative orientation, the joint protector 110 is in at least partially overlying, contacting, engaging and protecting relation to the corresponding joint 12. Concurrently, the first and second attachment assemblies 120 and 130 respectively, as well as the one or more straps 122 and 132 associated therewith, are in confronting relation to correspondingly disposed parts of the wearer which are adjacent to the need joint 12. In the example represented, such adjacent corresponding parts of the wearer may be the thigh and shin areas, adjacent the knee joint 12.

As also represented in FIG. 4, the joint protector 110, the first and second attachment assemblies 120 and 130 and the one or more straps 122 and 132 associated there with are all structurally and cooperatively adapted to assume a substantially linear, straight-line configuration along the length of the limb with which the joint 12 is associated, while maintaining an outwardly spaced at least partially non-engaging, non-contacting relation to the limb and joint 12.

In addition, in at least one embodiment the straps 122, 132 are made of an at least partially elastic material capable of at least a slight or minimal stretching. Accordingly, when the system 100 is disposed in a spaced orientation, as shown in FIG. 4, the straps 122, 132 are slightly taut so as to maintain alignment of the joint protector 110 with the corresponding joint. However, they are loose enough to enable further movement, such as stretching necessary to transition the joint protector 110 between an operative orientation, as shown in FIG. 3, and a spaced orientation as represented in FIG. 4. In this manner, the straps 122, 132 act similarly to tendons. They are also loose enough that, should the joint protector 110 be impacted from the side, such as if caught on a wall, corner, or snagged by an object, the joint protector 110 absorbs the force of the impact, and the straps 122, 132 also absorb some of the impact. Further, such flexibility of the straps 122, 132 facilitate the joint protector 110 moving in reaction to being snagged or the absorbed force, blow, etc. thereby at least partially transferring the resulting energy away from the joint.

Moreover, the straps 122, 132 are also sufficiently resilient such that as soon as the impacting force is no longer applied, the straps 122, 132 quickly return to their original position, along with the attached joint protector 110. Similarly, the resilient characteristic of the straps 122, 132 enable them and the connected joint protector 110 to automatically fall back into aligned relation to the joint when moving between an operative and spaced orientation, and vice versa. Accordingly, the straps 122, 132 may be of any material suitable for exerting a sufficient biasing force so as to maintain a "taut", intended positioning of themselves and of the joint protector 110. Examples include, but are not limited to, textiles, woven textiles, natural or synthetic materials, blends, elastics, rubber, polymer-based materials, bungee type materials, and combinations thereof, and may be fortified with chemical or material agents to increase and/or maintain strength, structural integrity, resiliency, elasticity, resistance to the elements, etc. Due in part to the elasticity and resiliency of the straps 122, 132 and the positioning and connection of the straps 122, 132 with the joint protector 110 and attachment to the wearer, the present system 100 is referred to as a "self-adjusting" system and or "automatic self-adjusting" system, requiring no direct manual manipulation of the straps 122, 132 and/or the joint protector 110 once the system 100 is appropriately positioned and attached to the wearer, in an intended manner.

Moreover, each of the straps 122, 132 is adjustable in length independently of the other straps 122, 132 so as to accommodate any of a range of sizes of a wearer. For example, the straps 122, 132 are adjustable so that the system 100 may be used by a person of any height, including short people (such as under five feet tall) and tall people (such as over six feet tall). The system 100 may also be used by children or adults. The length of each strap 122, 132 may be adjusted by at least the adjustable structuring of the corresponding attachment members 128. The straps 122 are also separately adjustable from the straps 132, to accommodate for varying lengths of limbs in a wearer.

As at least partially described herein, operative and structural features of the system 100 and the attendant assembly including the joint protector 110 and the first and second attachment assemblies 120 and 130 respectively, are structurally adapted to "automatically" move between and assume the operative orientation as represented in FIG. 3 and the spaced orientation as represented in FIG. 4. In more specific terms, such "automatic" movement between the operative orientation and the spaced orientation is meant to describe and be defined by an absent of direct engaging, gripping, handling or other direct manual manipulation of the joint protector 110 or the first and second attachment assemblies 120 and 130 respectively, by the wearer or any other individual. In contrast, such "automatic" movement and disposition between the operative and spaced orientations is accomplished by a predetermined positioning or orientation of the limb or other portion of the wearer's body with which the joint protector is operatively associated.

With primary reference to FIGS. 3 and 4 it is again assumed that the joint protector 110 and system 100 are operatively connected to the wearer's body and positioned to protect the knee joint 12. Accordingly movement of the knee joint 12 into a flexed or close bent orientation will result in the joint protector 110 and the first and second attachment assembly 120 and 130 respectively and automatically assuming the operative orientation. In contrast and as the represented in FIG. 4, disposition of the knee joint 12 in a straightened orientation will result in the joint protector 110 and the first and second attachment assemblies 120 and 130 respectively and automatically assuming the spaced orientation. Such "automatic" disposition of the joint protector 110 and the first and second attachment assemblies 120 and 130 is due in part to the operative disposition of the components of the system 100 and the fact that the one or more straps 122 and/or 132 respectively associated with associated with the first and second attachment assemblies 120 and 130 are at least partially formed from a resilient and/or elastic material.

By way of further example, when the system 100 is in the operative orientation of FIG. 3, any inadvertent "snagging" of the joint protector 110 and or the first and second attachment assemblies 120 and 130, resulting in an inadvertent displacement of the joint protector 110 can also be "automatically" corrected. More specifically, upon such a "snagging" engagement, the wearer merely has to substantially straighten the knee joint 12 or other corresponding joint, causing a dislodgment from the "snagging" engagement. As a result, the system 100 will at least briefly and/or temporarily assume an at least partially spaced orientation and subsequently and/or immediately thereafter assume the operative orientation, once the knee joint 12 is disposed into the bent orientation. This of course provides a significant improvement over known or conventional protecting devices which typically include one or more attachment members at least partially wrapped around and continuously engaging the leg or other limb of a wearer.

In at least one embodiment, the system 100 also includes a limb protector disposed adjacent to the joint protector 110 and disposable in aligned relation to at least a portion of a limb of the wearer, so as to protect the portion of the limb in a manner similar to the joint protector 110. For example, the limb protector is disposable in covering relation to a portion of a thigh, shin, forearm, upper arm, or other portion of a limb adjacent to the joint being protected by the instant system 100. In one embodiment, the limb protector is an extension of the joint protector 110, and may be considered the same structure. In other embodiments, the limb protector is adjacent but connected to the joint protector 110, and may be hingedly connected thereto so as to allow for movement and flexion of the joint.

The present invention is amenable to various configurations. For instance, in some embodiments multiple systems 100 may be used in tandem, on different joints, such as a separate system 100 on each knee or each elbow. In at least one of these tandem embodiments, such as when one system 100 is employed over one elbow and another system 100 is employed over the other elbow, the first attachment assembly 120 of each system 100 secures at or near the respective hand of the wearer, and the distal end 136 of the second attachment assembly 130 of one system 100 secures to the distal end 136 of the second attachment assembly 130 of the second system 100. Accordingly, the distal ends 136 of the second attachment systems 130 meet and connect to each other at the back or shoulders of the person, even if they do not also attach to the person. In embodiments covering the knees, the distal ends 126 of the second attachment assemblies 120 may meet and connect at the shoulders, chest, or behind the neck. In still other embodiments, a single system 100 includes two joint protectors 110, each having its own first attachment assembly 120 to connect to the foot or hand, but sharing a common second attachment assembly 130, which may stretch over the back, shoulders, neck, or other part of the wearer.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An assembly structured to protect a knee and knee joint of a wearer, said assembly comprising:

a joint protector, an attachment structure adapted to secure said joint protector to the wearer, said attachment structure including a first attachment assembly and a second attachment assembly, said first attachment assembly including a first strap extending vertically below said joint protector, said first strap comprising a distal end structured to define a first attachment member of said first strap, said first attachment member structured to be secured around the sole region of a foot of the wearer and at no time engaging a back of the wearer's leg, said second attachment assembly including at least two upper strap sections extending vertically above said joint protector and at no time engaging a back of the wearer's leg, each of said upper strap sections including and upper end and a lower end, said upper end comprising at least one upper attachment member structured to be secured to the wearer at a point vertically above the joint protector, said lower end of each of said upper strap sections being pivotally secured to said joint protector in a manner that permits each of said upper strap sections to be independently and at least partially laterally movable relative to one another to accommodate varied positioning of corresponding ones of said upper attachment members, and said first strap and said at least two upper straps structured and disposed to automatically engage said joint protector against the wearer's knee when the wearer's leg is bent during kneeling, and to minimize pressure against the wearer's knee when he the wearer's leg is straight.

2. The assembly as recited in claim 1 wherein said at least two upper strap sections are at least partially formed of an elastic material.

3. The assembly as recited in claim 1 wherein said at least two upper strap sections comprises an adjustable length.

4. The assembly as recited in claim 1 wherein said at least one upper attachment member is structured to adjust a length of a corresponding one of said at least two upper strap sections.

5. The assembly as recited in claim 1 comprises at least one cushioning portion disposed on an interior of said joint protector and structured to provide relief from pressure applied to the joint, at least when the knee is in a bent orientation.

6. The assembly as recited in claim 1 wherein said joint protector comprises at least one impact resistant portion disposed on an exterior of said joint protector and structured to reduce force applied to the joint from a supporting surface.

7. The assembly as recited in claim 1 wherein said joint protector comprises at least one frictional portion disposed on an exterior of said joint protector and structured to increase friction between said joint protector and a supporting surface.

8. The assembly as recited in claim 1 wherein said joint protector comprises at least one frictional portion disposed on an interior of said joint protector and adapted to reduce slippage between said joint protector and the wearer's knee when the wearer's leg is bent.

9. The assembly as recited in claim 1 wherein said joint protector, said at least two upper strap sections, and said first strap are collectively adapted for automatic disposition into an operative orientation, at least when the wearer's knee is in flexion.

10. The assembly as recited in claim 1 wherein said first strap is at least partially formed of an elastic material.

11. The assembly as recited in claim 1 wherein said first strap comprises an adjustable length.

12. The assembly as recited in claim 1 wherein said first strap further comprises a second attachment member, collectively structured for selective orientation between a fixed relation and an unfixed relation.

13. The assembly as recited in claim 12 wherein said fixed relation comprises fixing said first strap to said joint protector via said second attachment member.

14. The assembly as recited in claim 12 wherein said unfixed relation comprises said first strap in an unfixed relation to said joint protector via said second attachment member.

* * * * *